US011644039B2

(12) United States Patent
Ye et al.

(10) Patent No.: US 11,644,039 B2
(45) Date of Patent: May 9, 2023

(54) PUMP BOTTOM BEARING WITH TEMPERATURE SENSOR IN ELECTRICAL SUBMERSIBLE WELL PUMP ASSEMBLY

(71) Applicant: Baker Hughes Oilfield Operations LLC, Houston, TX (US)

(72) Inventors: Zheng Ye, Claremore, OK (US); Ignacio Martinez, Tulsa, OK (US); Brett Taylor Williams, Claremore, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 224 days.

(21) Appl. No.: 16/859,161

(22) Filed: Apr. 27, 2020

(65) Prior Publication Data

US 2020/0347849 A1 Nov. 5, 2020

Related U.S. Application Data

(60) Provisional application No. 62/842,233, filed on May 2, 2019.

(51) Int. Cl.
*F04D 25/06* (2006.01)
*F04D 27/00* (2006.01)
(Continued)

(52) U.S. Cl.
CPC ..... *F04D 25/0666* (2013.01); *E21B 41/0007* (2013.01); *E21B 43/128* (2013.01); *F04D 27/001* (2013.01)

(58) Field of Classification Search
CPC ..... F04D 25/0666; F04D 27/001; F04D 1/06; F04D 13/00; F04D 15/0088;
(Continued)

(56) References Cited

U.S. PATENT DOCUMENTS 2,670,687 A * 3/1954 Waskosky ..... F04D 1/04 415/88
5,033,937 A 7/1991 Wilson
(Continued)

FOREIGN PATENT DOCUMENTS

CN 103075369 A 5/2013
CN 104564712 A 4/2015
WO 2015026919 A1 2/2015

OTHER PUBLICATIONS

International Search Report and Written Opinion of PCT Application No. PCT/US2020/030148 dated Aug. 13, 2020: pp. 1-12.
(Continued)

*Primary Examiner* — Bryan M Lettman
(74) *Attorney, Agent, or Firm* — Bracewell LLP; Keith R. Derrington

(57) ABSTRACT

An electrical submersible pump has a tubular pump housing containing centrifugal pump stages and a rotatable shaft. A bearing mounts in the housing and has a shaft passage through which the shaft extends. A sensor hole extends through the housing and into the bearing. A temperature sensor is located within the sensor hole. The sensor hole has a closed end radially outward from the shaft passage. A sensor line leads from the temperature sensor to a sensing unit mounted at an upper or a lower end of the pump assembly.

20 Claims, 3 Drawing Sheets

(51) Int. Cl.
*E21B 41/00* (2006.01)
*E21B 43/12* (2006.01)

(58) Field of Classification Search
CPC ..... F04D 29/0473; F05D 2270/303; E21B 41/0007; E21B 43/128; F16C 17/243; F16C 41/00; F16C 2233/00; F16C 35/02
See application file for complete search history.

(56) References Cited

U.S. PATENT DOCUMENTS 7,208,855 B1* 4/2007 Floyd ..... E21B 43/128 385/98
8,328,529 B2 12/2012 Thompson et al.
9,441,633 B2 9/2016 Sheth et al.
9,541,091 B2 1/2017 Wilson et al.
10,164,500 B2 12/2018 Strattan et al.
2008/0298952 A1* 12/2008 Bouchard ..... F04D 29/059 417/63
2013/0148127 A1* 6/2013 Sheth ..... G01D 5/268 356/213
2013/0272898 A1* 10/2013 Toh ..... E21B 47/008 417/44.1
2014/0000345 A1* 1/2014 Wilson ..... G01D 5/35316 96/216
2014/0099211 A1* 4/2014 Sheth ..... E21B 47/008 417/63
2015/0132159 A1* 5/2015 Wilson ..... F04D 13/0693 417/410.1
2016/0201444 A1 7/2016 Hardee et al.
2016/0359388 A1* 12/2016 Strattan ..... F04D 15/0281
2019/0264540 A1* 8/2019 Crane ..... E21B 36/006

OTHER PUBLICATIONS

PCT International Preliminary Report on Patentability dated Nov. 11, 2021, for PCT/US2020/030148, 8 pages.
Supplementary European Search Report, Application No. 20799533 dated Dec. 13, 2022.

* cited by examiner

PUMP BOTTOM BEARING WITH TEMPERATURE SENSOR IN ELECTRICAL SUBMERSIBLE WELL PUMP ASSEMBLY

CROSS REFERENCE TO RELATED APPLICATION

This application claims priority to provisional application Ser. No. 62/842,233, filed May 2, 2019.

FIELD OF DISCLOSURE

The present disclosure relates to electrical submersible well pump assemblies (ESP), and in particular to a centrifugal pump having a temperature sensor mounted in a bottom bearing.

BACKGROUND

Electrical submersible pumps (ESP) are commonly used in hydrocarbon producing wells. An ESP includes a pump driven by an electrical motor. The pump is often a centrifugal pump having impellers rotated by a shaft assembly extending from the motor.

The rotating impellers cause a normal temperature increase during operation. If liquid well fluid ceases to flow into the pump stages while the impellers are still rotating, the pump stages may experience a rapid temperature increase. That can happen because of a mistakenly closed valve or a large gas bubble entering the pump. If the pump is operating at a much higher speed than conventional, or for a long period of time, the temperature can elevate high enough to cause serious damage, such as diffuser spin, unseated bushing inserts, and in extreme cases, fusing of the impellers to the diffusers.

It is known to employ temperature sensors at the discharge adapters of pumps to monitor the temperature of the well fluid as it discharges from the pump. Also, temperature sensors are commonly used to measure the temperature of the motor lubricant in the motor.

SUMMARY

An electrical submersible pump (ESP) for pumping well fluid from a well has a tubular pump housing with a longitudinal axis and a housing bore that is coaxial with the axis. A plurality of centrifugal pump stages are in the housing bore, each of the stages having an impeller and a diffuser. A rotatable shaft, mounted on the axis within the housing, rotates the impellers. The housing has a non-rotatable bearing with a passage through which the shaft extends. A sensor hole extends through the housing and into the bearing. A temperature sensor locates within the sensor hole.

In the embodiment shown, the bearing has a hub through which the passage extends. An outer wall coaxially extends around the hub and is spaced radially outward therefrom. A plurality of support arms extends from the hub to the outer wall. The sensor hole extends from one end of the bearing into one of the support arms.

The sensor hole may have a closed end spaced radially outward from the passage in the bearing. In the example shown, the sensor hole is inclined relative to the axis at an acute angle less than 90 degrees. The bearing is located in a bottom portion of the pump in the embodiment shown.

The ESP further comprises a motor and a seal section for sealing around a motor shaft, the seal section being between the motor and the pump. The housing comprises a cylindrical body and a base secured to a lower end of the body, the base having a connector for connecting the seal section to the pump. The bearing is located in the base. The sensor hole extends through the base into the bearing.

The ESP may also have a sensing unit located at one end of the ESP. A sensor line leads from the temperature sensor to the sensing unit. The sensing unit may comprise a motor gauge unit mounted to a lower end of a motor. The sensor line extends from the temperature sensor in the bearing to the motor gauge unit in one embodiment.

In the embodiment shown, the housing comprises a cylindrical body and a base having a threaded upper portion secured to a lower end of the body. The base has a base bore in which the bearing is mounted. The base has a connector flange with bolt holes for connecting the pump to a lower module of the ESP/A neck of smaller outer diameter than the upper portion and the connector flange defines a downward facing shoulder. The sensor hole has a sensor hole base portion extending upward and inward from the shoulder toward the axis. The sensor hole has a bearing portion aligned with the sensor hole base portion and extending within the bearing. A fitting secures the sensor line to the sensor hole base portion at the shoulder.

Figure 1:
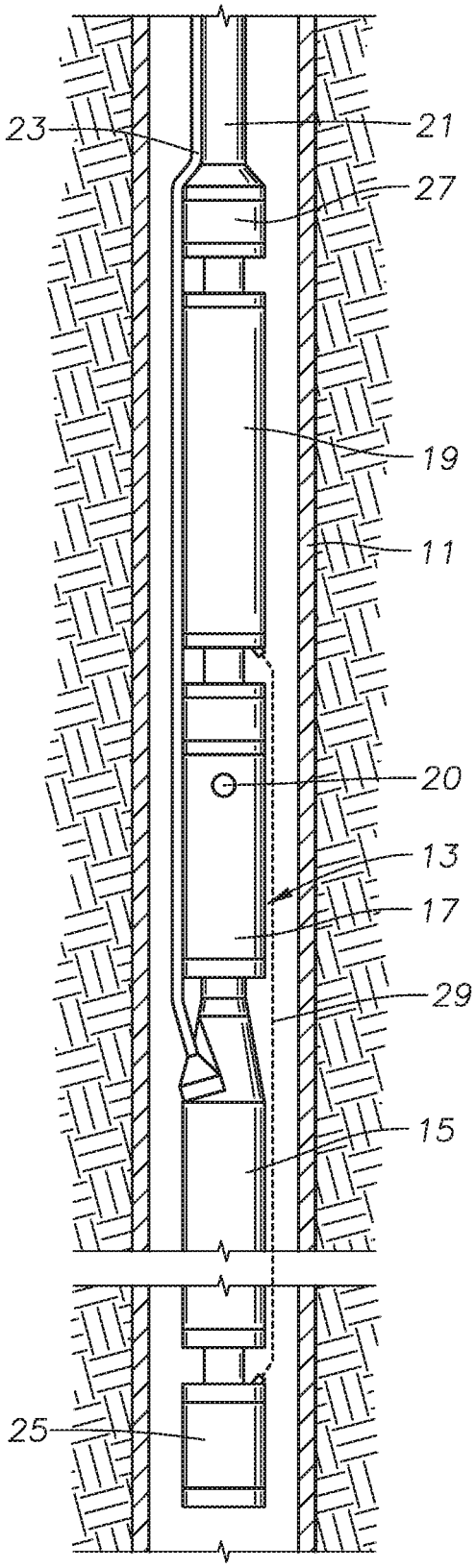
FIG. 1 is a schematic side view of an electrical submersible pump assembly having a pump housing with a temperature sensor in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates a cased well 11 having an electrical submersible well pump (ESP) 13 of a type commonly used to lift hydrocarbon production fluids from wells. The terms "upward", "downward", "above", "below" and the like are used only for convenience as ESP 13 may be operated in other orientations, such as horizontal.

ESP 13 has an electrical motor 15 coupled by a seal section 17 to a centrifugal pump 19. Pump 19 has an intake port 20 that may be at the lower end of pump 19, in a separate module, or in an upper part of seal section 17 as shown. If a gas separator (not shown) is employed, intake port 20 would be in the gas separator.

Motor 15 contains a dielectric motor lubricant for lubricating the bearings within. A pressure equalizer communicates with the lubricant in motor 15 and with the well fluid for reducing a pressure differential between the lubricant in motor 15 and the exterior well fluid. In this example, the pressure equalizer is contained within seal section 17. Alternately, the pressure equalizer could be located below motor 15, and other portions of seal section 17 could be above motor 15.

A string of production tubing 21 extending downward from a wellhead (not shown) supports ESP 13. Pump 19 discharges well fluid into production tubing 21. Alternately, ESP 13 could be secured to a string of coiled tubing located within a production conduit. In that event, pump 19 would discharge into an annulus surrounding the coiled tubing within the production conduit.

In this example, a power cable 23 extends downward alongside production tubing 21 and has a motor lead on its lower portion that connects to motor 15. If the ESP is installed on coiled tubing, the power cable would be inside the coiled tubing and the motor would normally be above the pump.

In this embodiment, a motor gauge unit 25 secures to the bottom of motor 15. Motor gauge unit 25 has sensors for measuring parameters of the motor lubricant, such as pressure and temperature. Signals from motor gauge unit 27 may be transmitted to a controller adjacent the wellhead by a separate instrument wire or by superimposing those signals on the motor windings within motor 15 and up power cable 23.

A discharge gauge unit 27 may be mounted to the upper end of pump 19. Discharge gauge unit 27 has sensors that sense the discharge pressure of the well fluid being pumped by pump 19. The signals from discharge gauge unit 27 may be transmitted down to motor gauge unit 25 on a signal line (not shown) for communication with the controller at the surface along with the signals from motor gauge unit 25. Alternately, the signals from discharge gauge unit 27 could be transmitted up a separate instrument wire to the controller at the surface.

A pump temperature sensor line 29 extends from the lower portion of pump 19 along the exteriors of seal section 17 and motor 15 to motor gauge unit 25. Alternately, pump temperature sensor line 29 could extend upward to discharge gauge unit 27. Also, temperature sensor line 29 could extend directly to a controller at the surface adjacent the wellhead. Sensor line 29 could be a wire or fiber optic line.

Figure 2:
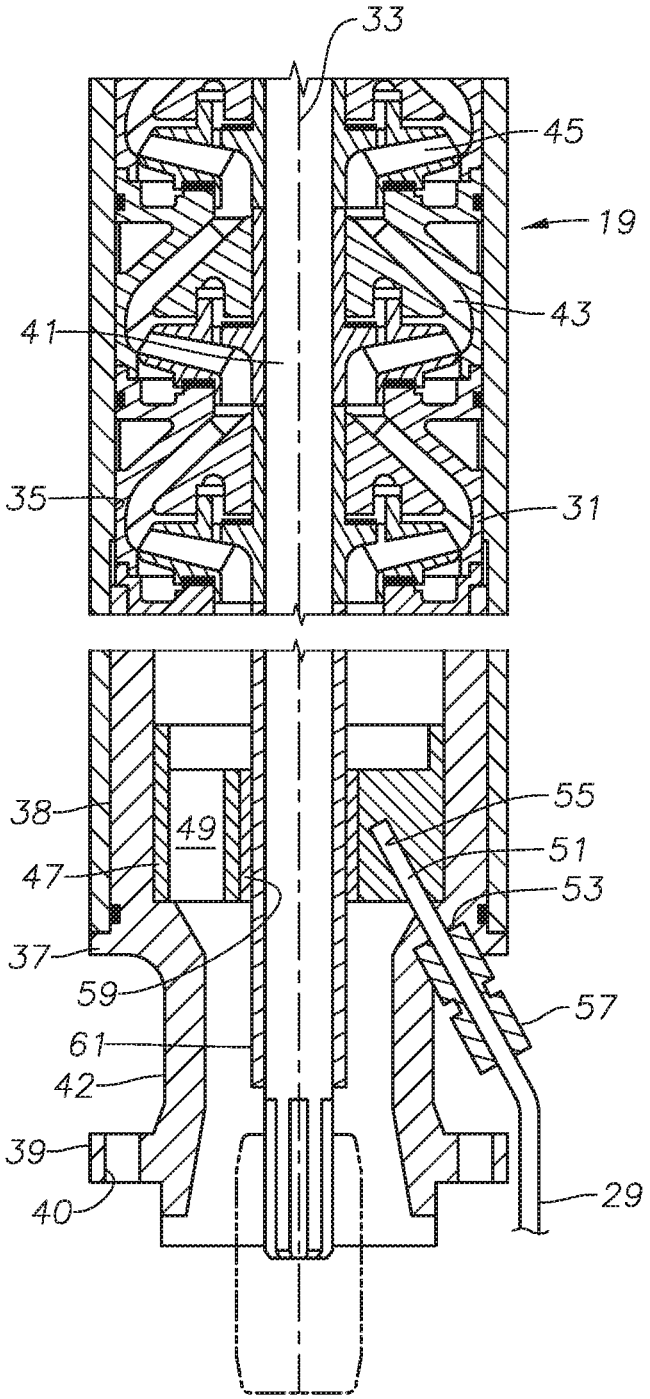
FIG. 2 is an axial sectional view of lower portions of the pump of the ESP in FIG. 1.

Referring to FIG. 2, pump 19 has a tubular body or housing 31 with a longitudinal axis 33 and a coaxial bore 35. A base 37, which may be considered to be a part of housing 31, secures by an upper threaded section 38 to the threads in the cylindrical portion of housing 31. Base 37 has features to connect pump 19 to a next lower module, which in this instance is seal section 17. In this example, the connector comprises an external flange 39 with bolt holes 40 for receiving bolts. A neck 42 extends upward from flange 39 to upper threaded section 38 and has a smaller outer diameter than the outer diameters of flange 39 and upper threaded section 38.

A shaft 41 rotated by motor 15 (FIG. 1) is mounted coaxially within housing 31. Shaft 41 has a lower splined end for coupling to a shaft in seal section 17 (FIG. 1), the coupling being indicated by the dotted lines. Pump 19 is a centrifugal type, having a large number of stages, each stage comprising a diffuser 43 and an impeller 45. Diffusers 43 do not rotate relative to housing 31. Shaft 41 rotates impellers 45 relative to housing 31.

A non-rotating bottom bearing 47 below diffusers 43 and impellers 45 radially stabilizes shaft 41. Bottom bearing 47 has flow channels 49 to enable the upward passage of well fluid. A similar top bearing (not shown) provides radial stabilization to the upper end of shaft 41. Bottom bearing 47 locates within an upper portion of the bore in base 37 in this example.

A temperature sensor 51, such as a thermocouple, fiber optic or other temperature sensing device, is located within bottom bearing 47. A base sensor hole 53 extends inward and upward through the side wall of base 37 and aligns with a bearing sensor hole 55 in bottom bearing 47. Temperature sensor 51 locates within bearing sensor hole 55, and temperature sensor line 29 extends through base sensor hole 53 to temperature sensor 51. Temperature sensor 51 and at least portions of temperature sensor line 29 may have a metal sheath. A conventional swage type fitting 57 secures by threads to base 37, clamping temperature sensor line 29 in base sensor hole 53.

Bottom bearing 47 has an axial bore with a shaft passage 60 defined by a non-rotating bushing 59, which may be of a carbide material. Bushing 59 comprises a journal portion of bearing 47. Shaft 41 will typically have a shaft sleeve 61 that is keyed to shaft 41 for rotation. Shaft sleeve 61 is in rotational sliding engagement with bottom bearing bushing 59. Bearing sensor hole 55 has a closed end that is radially outward from bushing 59.

Figure 3:
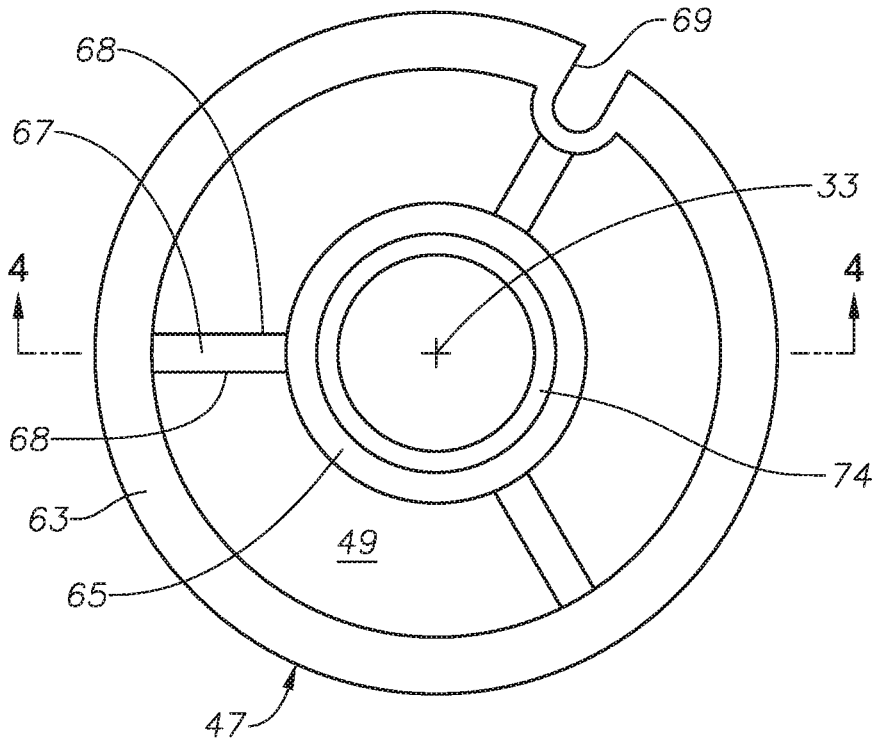
FIG. 3 is top view of the bottom bearing of the pump of FIG. 2, shown removed from the pump.
Figure 4:
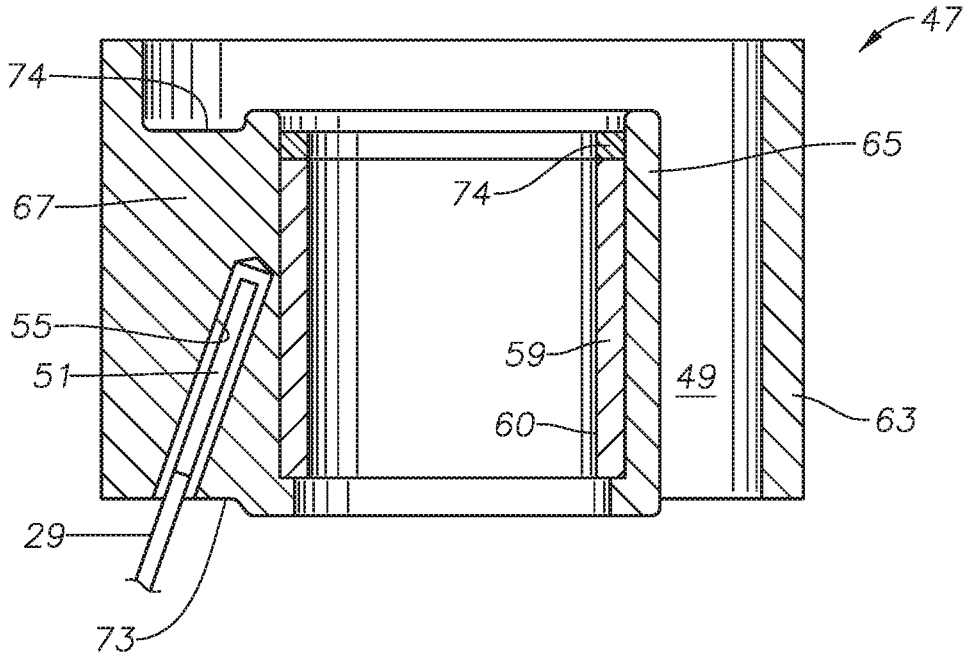
FIG. 4 is a sectional view of the bottom bearing of FIG. 3, taken along the line 4-4 of FIG. 3.

Referring to FIGS. 3 and 4, bottom bearing 47 has a cylindrical outer wall 63 that coaxially surrounds a cylindrical inner wall or hub 65. A number of support arms 67 (three shown) extend from hub 65 to outer wall 63. The spaces between arms 67 define flow channels 49. Arms 67 may be integrally formed with hub 65 and outer wall 63. Arms 67 are located in radial planes from axis 33 in this example, and they are evenly spaced apart at 120 degree angles. Each arm 67 may have flat sides 68 that are parallel with each other. An axially extending slot 69 in outer wall 63 receives an anti-rotation pin (not shown). The anti-rotation pin engages a mating slot (not shown) in the bore of base 37 (FIG. 5) to prevent rotation of bottom bearing 47 relative to base 37.

Each arm 67 has an upper end 71 that may be rounded and recessed below the upper end of outer wall 63. Each arm 67 has a lower end 73 that may be substantially flush with the lower end of outer wall 63. The upper end of hub 65 may be substantially flush with each arm upper end 71. The lower end of hub 65 is substantially flush with the lower end 73 of each arm 67 in this example. Bushing 59 is secured in the bore of hub 65 by a lower shoulder in the bore of hub 65 and a conventional retainer ring on 74 engaging the bore of hub 65 on the upper end bushing 59.

Bearing sensor hole 55 extends into the lower end 73 of one of the arms 67 and has a closed upper end within arm 67 a short distance radially outward from bushing 59. Bearing sensor hole 55 is in a plane parallel with and between the flat sides 68 of arm 67. Bearing sensor hole 55 has a smaller diameter than the thickness of arm 67 measured from one side 68 to the opposite side 68. In this example, bearing sensor hole 55 is located in a radial plane of axis 33. Bearing sensor hole 55 extends upward and inward at an acute angle relative to axis 33 that is less than 90 degrees and is illustrated to be about 20 degrees. The closed upper end of bearing sensor hole 55 is closer to bushing 59 than to the exterior of outer wall 63.

Figure 5:
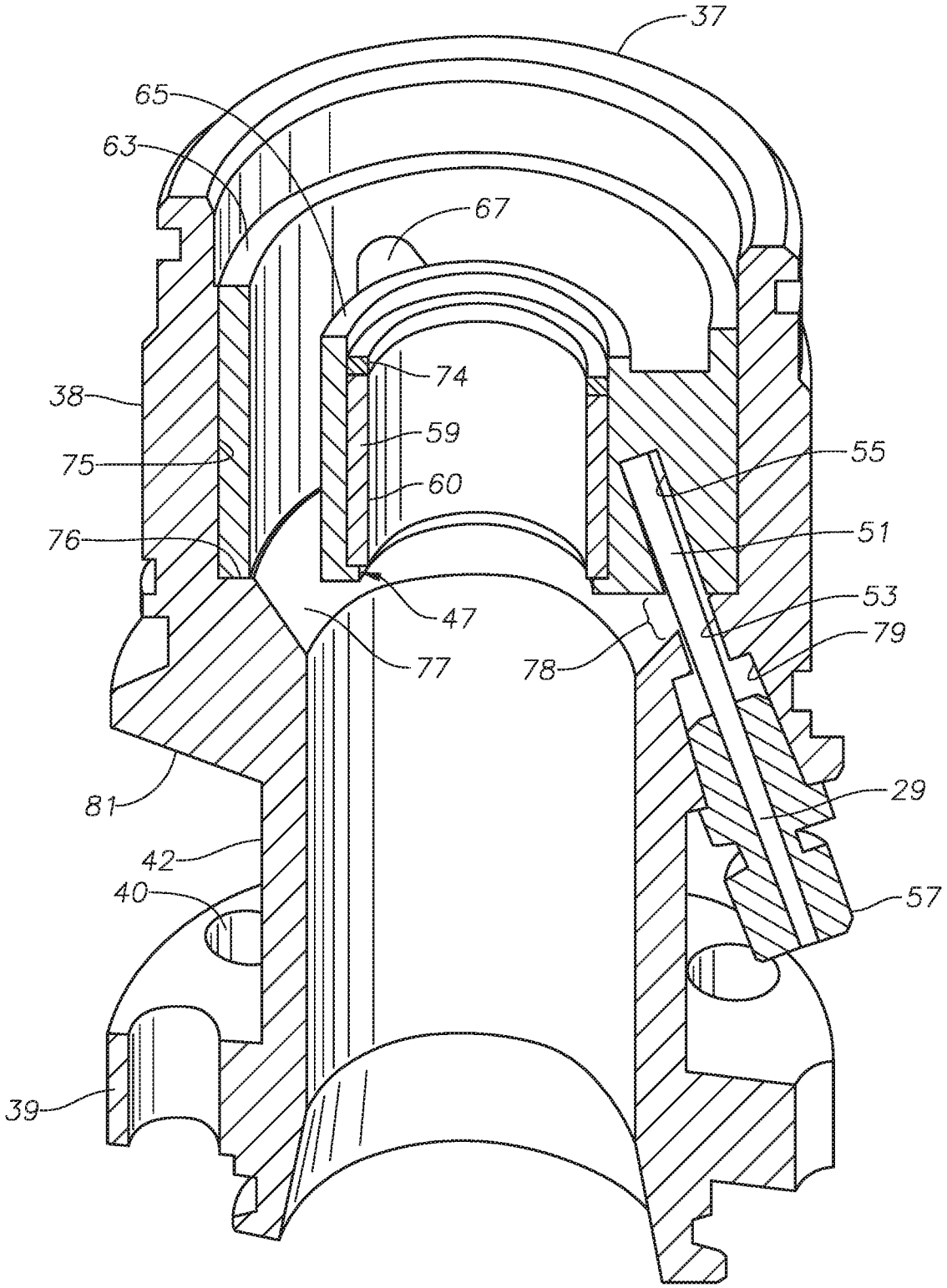
FIG. 5 is a partially sectioned perspective view of the bottom bearing of FIG. 3 shown within the base of the pump.

Referring to FIG. 5, bottom bearing 47 fits within a counterbore 75 of base 37, landing on an upward-facing shoulder 76. Bottom bearing 47 may be simply dropped in place, or secured to base 37 in various manners, such as by a press-fit. Alternately, bottom bearing 47 could be integrally formed with base 37.

The upper end of base sensor hole 53 is separated from the lower end of bearing sensor hole 55 in this example by a short distance or gap 78 due to a conical band 77 extending downward from upward facing shoulder 76 in the bore of base 37. However, it would be feasible to make the upper end of base sensor hole 53 flush with the lower end of bearing sensor hole 55. Swage fitting 57 secures to a threaded hole 79 in base 37. Threaded hole 79 extends upward and inward from a downward facing shoulder 81 at the upper end of base neck 42.

In operation, as pump 19 operates, it will increase in temperature to a normal operating temperature. Liquid well fluid flowing through pump 19 will provide cooling for the components, including bottom bearing 47. In the event pump 19 become gas locked, or a valve for the flowing well fluid is accidentally closed, the rotating shaft 41 could rapidly increase the temperature of bottom bearing 47, causing damage to bottom bearing 47. The spinning impellers 45 would also rapidly increase in temperature. It unchecked, impellers 45 could fuse to diffusers 43. This rapid increase particularly occurs when pump 19 is operating at a much higher speed than a conventional speed.

Temperature sensor 51 will sense the temperature and send a signal over sensor line 29 to motor gauge unit 25, which in turn transmits the signal to the controller adjacent the wellhead. In case of a rapid temperature increase, the controller will quickly take remedial action, such as slowing the speed of pump 19 or completely shutting it down. Locating temperature sensor 51 in bottom bearing 47 places it closer to the pump intake 20 than the diffusers 43 and impellers 45 so that it will encounter a rise in temperature due to a loss in liquid well fluid flow before the temperature rise occurs in diffusers 43 and impellers 45.

The present disclosure described herein, therefore, is well adapted to carry out the objects and attain the ends and advantages mentioned, as well as others inherent therein. While one embodiment of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. An electrical submersible pump (ESP) for pumping a well fluid from a well, comprising:

a tubular pump housing having a longitudinal axis and a housing bore that is coaxial with the axis;

a pump having a plurality of centrifugal pump stages in the housing bore, each stage of the plurality of centrifugal pump stages having an impeller and a diffuser;

a rotatable shaft mounted on the axis within the tubular pump housing for rotating the impellers;

a non-rotatable bearing mounted in the tubular pump housing, the bearing comprising a hub having a shaft passage through which the shaft extends and an outer wall spaced radially outward from the hub, and a support arm extending between the hub and outer wall and in a path of the well fluid;

a sensor hole extending through the tubular pump housing, a lower axial end of the support arm, and into the support arm; and a temperature sensor located within a portion of the sensor hole inside the support arm.

2. The ESP according to claim 1, wherein the support arm comprises:

a plurality of support arms extending from the hub to the outer wall.

3. The ESP according to claim 1, wherein:

the sensor hole has a closed end spaced radially outward from the shaft passage in the bearing.

4. The ESP according to claim 1, wherein:

the sensor hole is inclined relative to the axis at an acute angle less than 90 degrees.

5. The ESP according to claim 1, wherein:

the bearing is located in a bottom portion of the pump.

6. The ESP according to claim 1, wherein:

the ESP further comprises a motor and a seal section for sealing around a motor shaft, the seal section being between the motor and the pump;

the tubular pump housing comprises a cylindrical body and a base secured to a lower end of the body, the base having a connector for connecting the seal section to the pump, the bearing being located in the base; and the sensor hole extends through the base into the bearing.

7. The ESP according to claim 1, further comprising:

a sensing unit located at one end of the ESP; and a sensor line leading from the temperature sensor to the sensing unit.

8. The ESP according to claim 1, wherein the ESP further comprises:

a motor;

a motor gauge unit mounted to a lower end of the motor; and a sensor line extending from the temperature sensor in the bearing to the motor gauge unit.

9. The ESP according to claim 1, wherein:

the tubular pump housing comprises a cylindrical body and a base having a threaded upper portion secured to a lower end of the cylindrical body, the base having a base bore in which the bearing is mounted;

the base has a connector flange with bolt holes for connecting the pump to a lower module of the ESP, the connector flange being joined to the upper portion of the base by a neck of a smaller outer diameter than the upper portion of the base and the connector flange, defining a downward facing shoulder;

the sensor hole has a sensor hole base portion extending upward and inward from the downward facing shoulder toward the axis;

the sensor hole has a sensor hole bearing portion aligned with the sensor hole base portion and extending within the bearing; wherein the ESP further comprises:

a sensor line connected with the sensor and extending from the base for transmitting a signal from the sensor; and a fitting that secures to the sensor line to the sensor hole base portion at the downward facing shoulder.

10. An electrical submersible pump (ESP) for pumping a well fluid from a well, comprising:

a tubular pump housing having a longitudinal axis;

a plurality of centrifugal pump stages mounted within the tubular pump housing, each stage of the plurality of centrifugal pump stages having an impeller and a diffuser;

a rotatable shaft mounted on the axis within the tubular pump housing for rotating the impellers;

a base secured to a lower end of the tubular pump housing;

a non-rotatable bushing in the base through which the shaft extends;

an elongated support arm coupled with the bushing and extending radially outward from the bushing in a flow path of well fluid;

a sensor hole extending through the base into the support arm and toward the axis, the sensor hole having a closed end that is radially outward from the bushing and a length oriented oblique with the axis;

a temperature sensor located within a portion of the sensor hole in the support arm; and a sensor line connected to the temperature sensor and extending from the base for transmitting a signal of the temperature sensor.

11. The ESP according to claim 10, further comprising:

a hub containing the bushing;

wherein the support arm comprises a plurality of support arms extending outward from the hub.

12. The ESP according to claim 10, wherein:

the sensor hole extends upward and inward toward the axis.

13. The ESP according to claim 10, further comprising:

a sensing unit located at one end of the ESP; and wherein the sensor line extends from the temperature sensor to the sensing unit.

14. The ESP according to claim 10, wherein the ESP further comprises:

a motor;

a motor gauge unit mounted to a lower end of the motor; and wherein the sensor line extends from the temperature sensor to the motor gauge unit.

15. An electrical submersible pump (ESP) for pumping a well fluid from a well, comprising:

a tubular pump housing having a longitudinal axis;

a base having an upper portion secured to a lower end of the tubular pump housing and a connector flange below and connected to the upper portion by a neck of lessor diameter than the upper portion, defining a downward facing shoulder between the neck and the upper portion, the base having a base bore;

a plurality of centrifugal pump stages in the tubular pump housing, each stage of the plurality of centrifugal pump stages having an impeller and a diffuser;

a rotatable shaft mounted on the axis within the tubular pump housing for rotating the impellers;

a non-rotatable bearing having an outer wall mounted in the base bore, the bearing having a hub containing a bushing through which the shaft extends, the hub being joined to the outer wall by a plurality of support arms, defining flow passages between the hub and outer wall and between adjacent support arms for the passage of the well fluid;

a base sensor hole having an outer end at the downward facing shoulder and extending upward and inward through the base;

a bearing sensor hole aligned with the base sensor hole and extending into one of the plurality of support arms of the bearing, the bearing sensor hole having a closed end inside the one of the plurality of support arms and that is spaced radially outward from the bushing and an open end on a lower axial side of the one of the plurality of support arms;

a temperature sensor located within a portion of the bearing sensor hole within the one of the plurality of support arms; and a sensor line connected to the temperature sensor and extending out of the base sensor hole for transmitting a signal from the temperature sensor.

16. The ESP according to claim 15, further comprising:

a sensing unit located at one end of the ESP; and wherein the sensor line leading from the temperature sensor to the sensing unit.

17. The ESP according to claim 15, wherein the ESP further comprises:

a motor;

a motor gauge unit mounted to a lower end of the motor; and wherein the sensor line extends from the temperature sensor to the motor gauge unit.

18. The ESP according to claim 15, wherein the downward facing shoulder is conical.

19. The ESP according to claim 15, further comprising:

a fitting that secures to the sensor line to the base sensor hole at the shoulder.

20. The ESP according to claim 15, further comprising:

a conical section in the base bore extending downward and inward from a cylindrical section in the base bore; wherein the bearing is mounted in the cylindrical section of the base bore, and the conical section extends downward from the bearing; and a lower end of the bearing sensor hole is spaced from the upper end of the base sensor hole by a gap.

* * * * *